US005651501A

United States Patent [19]

Maley et al.

[11] Patent Number: 5,651,501

[45] Date of Patent: Jul. 29, 1997

[54] FLUID DAMPING OF A VALVE ASSEMBLY

[75] Inventors: Dale C. Maley, Fairbury; Ronald Dean Shinogle, Peoria, both of Ill.

[73] Assignee: Caterpillar Inc., Peoria, Ill.

[21] Appl. No.: 172,478

[22] Filed: Dec. 23, 1993

[51] Int. Cl.[6] ..... F02M 51/06

[52] U.S. Cl. ..... 239/88; 239/124; 239/193; 251/53

[58] Field of Search ..... 239/5, 88, 89, 239/90, 91, 95, 96, 124, 581.1, 193; 251/53

[56] References Cited

U.S. PATENT DOCUMENTS

| | | | |
|---|---|---|---|
| 2,144,862 | 1/1939 | Truxell, Jr. . | |
| 3,821,967 | 7/1974 | Sturman et al. . | |
| 4,107,546 | 8/1978 | Sturman et al. . | |
| 4,129,253 | 12/1978 | Bader, Jr. et al. | 239/88 |
| 4,230,156 | 10/1980 | Frantz . | |
| 4,264,538 | 4/1981 | Moore et al. | 239/193 X |
| 4,408,718 | 10/1983 | Wich | 239/88 |
| 4,516,600 | 5/1985 | Sturman et al. . | |
| 4,526,519 | 7/1985 | Mowbray et al. | 239/88 X |
| 4,541,454 | 9/1985 | Sturman et al. . | |
| 4,582,294 | 4/1986 | Fargo . | |
| 4,585,176 | 4/1986 | Kubach et al. | 239/585.1 |
| 4,605,171 | 8/1986 | Trachte et al. . | |
| 4,606,502 | 8/1986 | Naschberger . | |
| 4,627,597 | 12/1986 | Brausfeld et al. . | |
| 4,634,096 | 1/1987 | Hara . | |
| 4,643,223 | 2/1987 | Abe et al. . | |
| 4,653,455 | 3/1987 | Eblen et al. . | |
| 4,669,659 | 6/1987 | Leblanc et al. | 239/124 X |
| 4,702,212 | 10/1987 | Best et al. . | |
| 4,813,599 | 3/1989 | Greiner et al. . | |
| 4,831,989 | 5/1989 | Haines . | |
| 4,844,339 | 7/1989 | Sayer et al. | 239/5 |
| 4,856,713 | 8/1989 | Burnett . | |
| 4,941,612 | 7/1990 | Li | 239/88 |
| 4,964,571 | 10/1990 | Taue et al. | 239/88 |
| 4,969,600 | 11/1990 | Nicol | 239/88 |
| 4,972,996 | 11/1990 | Cerny . | |
| 4,988,074 | 1/1991 | Najmolhoda . | |
| 4,993,637 | 2/1991 | Kanesaka | 239/96 |
| 5,016,821 | 5/1991 | Hans et al. . | |
| 5,044,339 | 9/1991 | Udo Hafner . | |
| 5,070,595 | 12/1991 | Perkins et al. . | |
| 5,076,241 | 12/1991 | Takahashi et al. . | |
| 5,096,121 | 3/1992 | Grinsteiner | 239/88 |
| 5,121,730 | 6/1992 | Ausman et al. . | |
| 5,143,291 | 9/1992 | Grinsteiner | 239/88 |
| 5,143,301 | 9/1992 | Reiter et al. . | |
| 5,170,987 | 12/1992 | Krauss et al. . | |
| 5,191,867 | 3/1993 | Glassey . | |
| 5,265,804 | 11/1993 | Brunel | 239/585.1 X |
| 5,375,576 | 12/1994 | Ausman et al. . | |

*Primary Examiner*—William Grant
*Attorney, Agent, or Firm*—Marshall, O'Toole, Gerstein, Murray & Borun; William E. McCracken

[57] ABSTRACT

A valve for use in a fuel injector includes a moveable valve member disposed in a first chamber and an armature coupled to the valve member and reciprocally disposed in a second chamber which dampens the motion of the valve member when fluid is present in the second chamber. A fluid passageway extends into the second chamber and delivers fluid to the second chamber while a further fluid passageway drains fluid from the second chamber when the fluid within the second chamber reaches a predetermined level.

17 Claims, 4 Drawing Sheets

FLUID DAMPING OF A VALVE ASSEMBLY

TECHNICAL FIELD

The present invention relates generally to fuel injection systems and, more particularly, to a fuel injector having a poppet valve with reduced bounce.

BACKGROUND ART

Prior fuel injection systems which may be used with, for example, diesel engines, have typically been of the pump-line-injector type or the unit injector type. A pump-line-injector fuel injection system includes a main pump which pressurizes fuel to a high level, e.g., on the order of about 103 to 138 MPa (about 15,000 to 20,000 p.s.i.), and individual fuel injectors which are coupled by fuel supply lines to the pump. In a unit injector system, a low-pressure transfer pump delivers fuel to a plurality of unit injectors, each of which includes means for pressurizing the fuel to a relatively high value, again on the order of about 103 to 138 MPa (15,000 to 20,000 p.s.i.) or greater.

Fuel injectors of the electronically-controlled unit injector type typically deliver fuel which is at a low pressure, for example, 60 p.s.i., to a pressure chamber and isolate the fuel within the pressure chamber using, for example, a spill control valve such as a poppet valve having a valve seating portion which comes into contact with a valve seat to isolate the pressure chamber from the fuel source. Alternatively, a spool valve may be used in place of a poppet valve. The fuel within the pressure chamber is then pressurized before being injected through a check valve into an engine combustion chamber. A spring forces the spill poppet valve of such a fuel injector against a stop so that the poppet valve is biased in an open position. Furthermore, a solenoid or other actuator controls the movement of the spill poppet valve assembly to force the valve seating portion into contact with the valve seat.

Fast actuation or deactivation of the solenoid, however, may cause the poppet valve to bounce or rebounce after an initial contact with the valve seat or stop. Bounce during closing of the poppet valve causes incomplete isolation of the fuel within the pressure chamber and slows the pressurization step of the fuel injection cycle resulting in lower engine thermal efficiency and higher exhaust emissions. If a bounce of great enough magnitude occurs during opening, the poppet valve can reseat against the valve seat causing pressurized fuel within the pressure chamber to create an undesired secondary injection of fuel into the engine combustion chambers.

It is known to dampen the movement of a valve within a fuel injector body. Trachte, et al., U.S. Pat. No. 4,605,171, issued on Aug. 12, 1986 for example, discloses a fuel injector which dampens the motion of a valve as the valve reciprocates within an injector body. During a fuel injection cycle, pressurized fuel within the injector body acts on an annular ring which is coupled to the valve to force the valve in an opening direction and thereby to cause fuel to be injected into an engine combustion chamber. As the valve moves in the opening direction, an end of the valve, which is disposed in a fuel filled damping chamber, moves out of the damping chamber to increase the volume of the damping chamber and, thereby, to decrease the pressure of the fuel within the damping chamber. The low pressure fuel within the damping chamber acts on the end of the valve to the damp the motion of the valve as the valve moves toward the open position. The damping chamber does not, however, prevent valve bounce when the valve reciprocates to the closed position.

DISCLOSURE OF THE INVENTION

According to one aspect of the present invention a valve for a fuel injector comprises a moveable valve member which is disposed in a first chamber and means coupled to the valve member and disposed in a second chamber for damping motion of the valve member when fluid is present in the second chamber. The valve also includes means extending into the second chamber for admitting fluid therein and means for draining fluid from the second chamber.

Preferably, the moveable valve member reciprocates between a first position, wherein the valve member blocks the flow of fluid through the first chamber, and a second position. The damping means may include a valve head which reciprocates within the second chamber and displaces fluid within the second chamber during the reciprocal motion to dampen the motion of the valve member.

The admitting means may include a passageway which connects the first chamber to the second chamber to deliver fluid within the first chamber into the second chamber. Preferably, the fluid flow capacity of the admitting means is substantially less then the fluid flow capacity of the first chamber. The fluid flow capacity of the admitting means may be chosen so that the fluid within the second chamber substantially evaporates upon exiting the chamber through the draining means.

The valve member may be disposed within a bore of a valve element such that a narrow passageway exists between an outer surface of the valve member and an inner surface of the bore. Furthermore, the draining means may include a triangularly-shaped passageway disposed at a predetermined level in the second chamber.

According to another aspect of the present invention, an injector includes a fluid inlet, a fluid outlet and a first chamber connecting the fluid inlet to the fluid outlet. A valve member reciprocates between a first position wherein the valve member blocks the first chamber to isolate the fluid inlet from the fluid outlet, and a second position. A first fluid passageway connects the first chamber to the second chamber and delivers fluid from the first chamber to the second chamber so that fluid within the second chamber dampens the motion of the valve member. A second fluid passageway drains fluid from the second chamber.

According to another aspect of the present invention, a method of damping the motion of a valve member which is reciprocally disposed within a first chamber of a fuel injector includes the steps of providing a valve element which is coupled to the valve member and which is reciprocally disposed within a second chamber, delivering fluid to the second chamber so that the fluid within the second chamber dampens the motion of the valve element within the second chamber, and draining fluid from the second chamber when fluid reaches a predetermined level. therein.

BEST MODE FOR CARRYING OUT THE INVENTION

Figure 1:
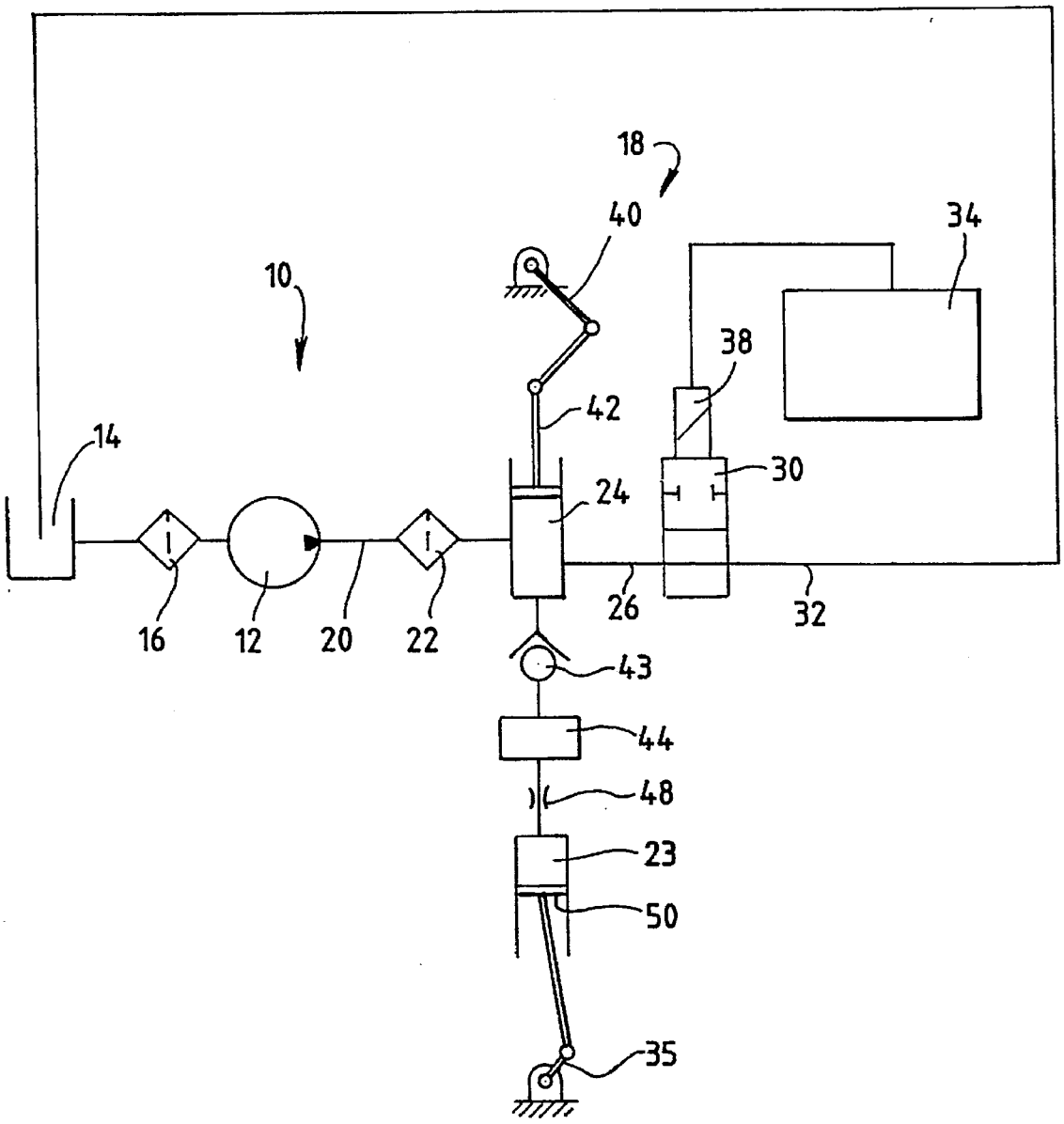
FIG. 1 comprises a combined schematic and block diagram of a unit fuel injector in conjunction with a mechanically-actuated electronically-controlled unit injector fuel system.

Referring now to FIG. 1, a mechanically-actuated electronically-controlled fuel injection system 10 is illustrated schematically. Although the fuel injection system 10 is particularly adapted for use in a diesel-cycle direct-injection internal combustion engine, the fuel injection system 10 may be used with any type of diesel engine, spark ignition engine or any other type of engine where it is necessary or desirable to inject fuel into an engine combustion chamber.

The fuel injection system 10 includes a transfer pump 12 which pumps fuel at relatively low pressure from a fuel tank 14 through a filter 16, one or more fuel supply lines or conduits 20 and one or more fuel filters 22 to one or more fuel injectors 18 which inject fuel into associated combustion chambers or cylinders 23 of an internal combustion engine. While only one fuel injector 18 is shown in FIG. 1, it should be noted that any number of fuel injectors may be used to inject fuel into a like number of associated combustion chambers.

Figure 2:
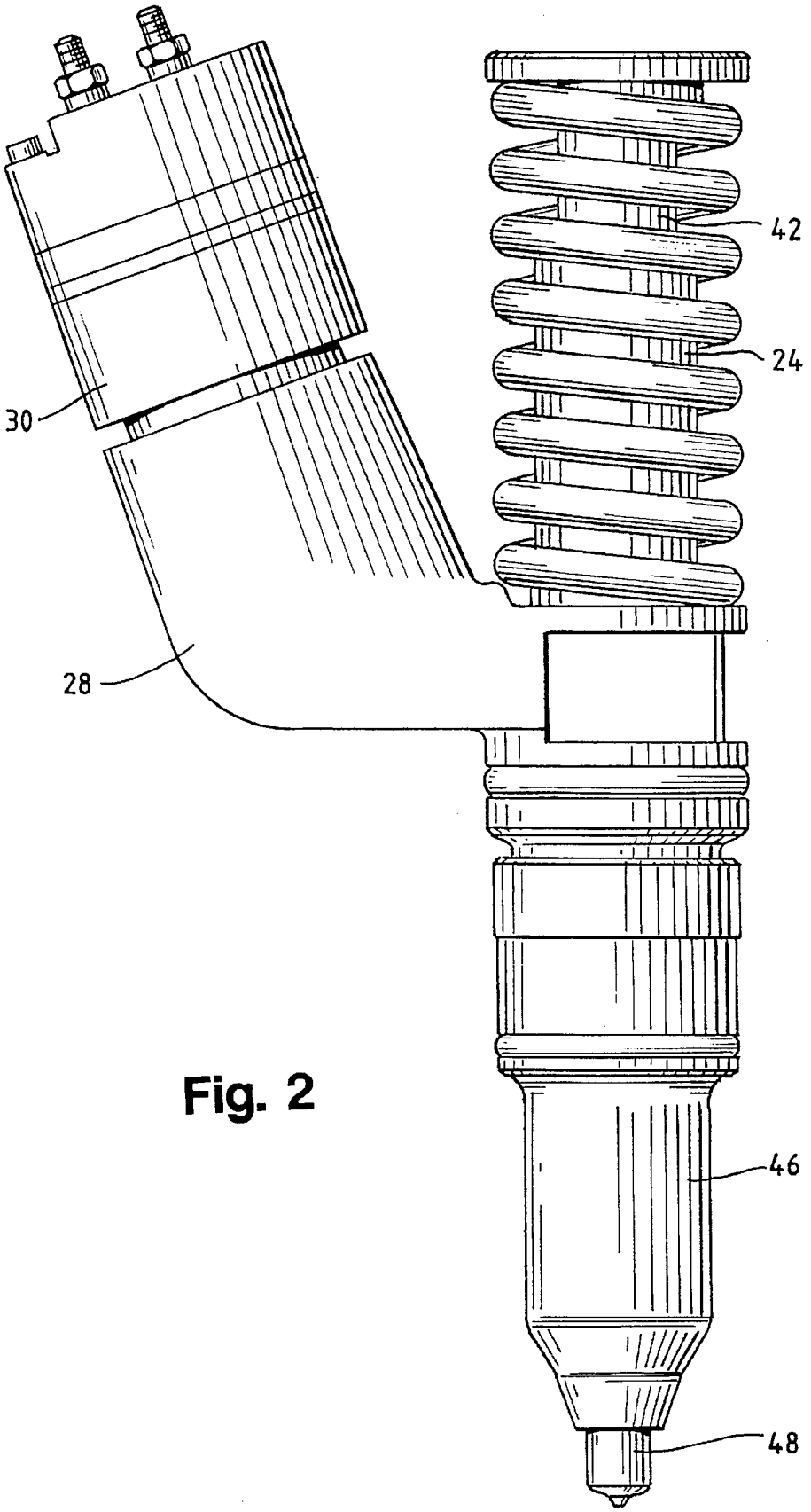
FIG. 2 comprises an elevational view of the unit fuel injector illustrated in FIG. 1.
Figure 3:
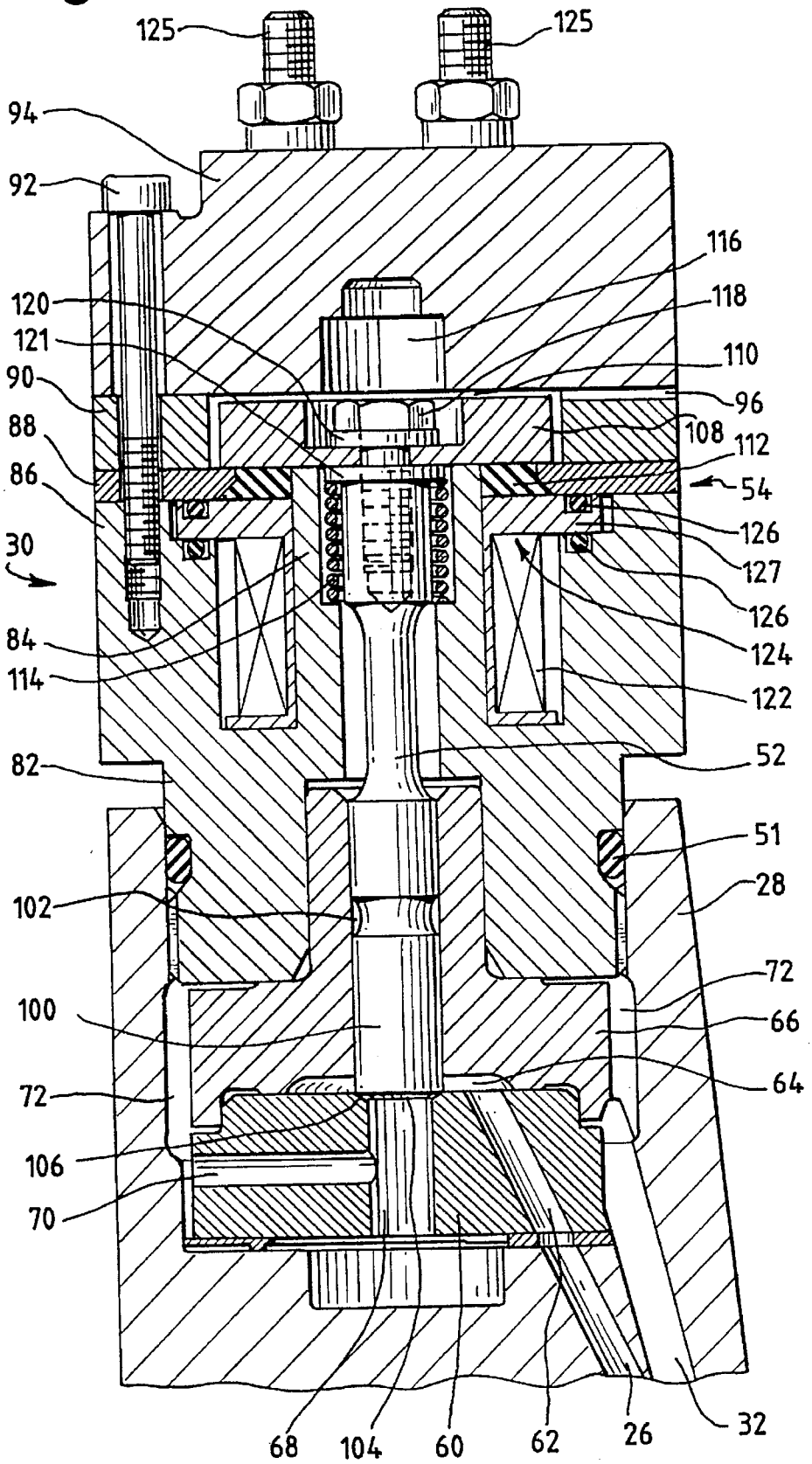
FIG. 3 comprises an elevational view, partly in section, of a spill control Valve according to the present invention.

Referring also to FIGS. 2 and 3 wherein a unit fuel injector 18 is shown, fuel is delivered to a pumping or pressurizing assembly 24 and, through a fuel conduit 26 which is located in an injector body 28 (shown in FIGS. 2 and 3), into a spill control valve 30. The fuel passes out of the spill control valve 30 and is delivered back to the fuel tank 14 (FIG. 1) through a fuel conduit 32, which is also located in the injector body 28, and other passages defined in the engine.

During operation, an electronic control module (ECM) 34 detects one or more engine operating conditions, such as the angular rotative position of an engine crankshaft 35. When fuel is to be injected into the engine combustion chamber 23, the ECM 34 electrically energizes an actuator such as a solenoid 38 associated with the spill control valve 30 which closes the spill control valve 30 and isolates the pumping assembly 24 from the fuel tank 14. While the spill control valve 30 is closed, an engine driven camshaft 40, which is coupled to the crankshaft 35, actuates a plunger 42 which pressurizes the fuel within the pumping assembly 24 to a relatively high pressure of, for example, about 138 MPa (20,000 p.s.i.). The fuel within the pumping assembly 24 is admitted through a one-way valve 43 into a check valve 44 of a nozzle assembly 46 (shown in FIG. 2). When the fuel within the check valve 44 reaches a threshold pressure (called "valve opening pressure" or VOP), the check valve 44 opens and admits fuel through a nozzle tip 48 into the combustion chamber 23. Thereafter, the fuel within the combustion chamber 23 ignites with compressed air and forces a piston 50 downward which, in turn, rotates the crankshaft 35, as is conventional.

The rotation of the camshaft 40 is synchronized with rotation of the crankshaft 35 and, therefore, the position of the piston 50 is variably synchronized with the position of the plunger 42. As is evident from the foregoing, the opening and closing of the spill control valve 30, which is variably synchronized with actuation of the plunger 42, controls the pressurization of fuel within the pumping assembly 24 and, thereby, variably controls the delivery (i.e. timing and quantity) of fuel to the combustion chamber 23. It is important, therefore, that the opening and closing operations of the spill control valve 30 be as rapid and accurately controlled as possible and that the spill control valve 30 opens and closes with little or no bounce.

Referring now specifically to FIG. 3, the control valve 30, which is shown mounted in the injector body 28 with an O-ring 51 therebetween, includes a poppet valve 52 disposed within a valve body 54. The valve body 54 includes a valve seat 60 having a passageway 62 through which fuel is provided from the inlet fuel conduit 26 to a fuel chamber 64 located above the valve seat 60 and below a barrel 66. The valve seat 60 also includes a central aperture 68 which communicates with a transverse passageway 70 which, in turn, communicates with an annular cavity 72 in fluid communication with the outlet fuel conduit 32 of the injector body 28.

Figure 4:
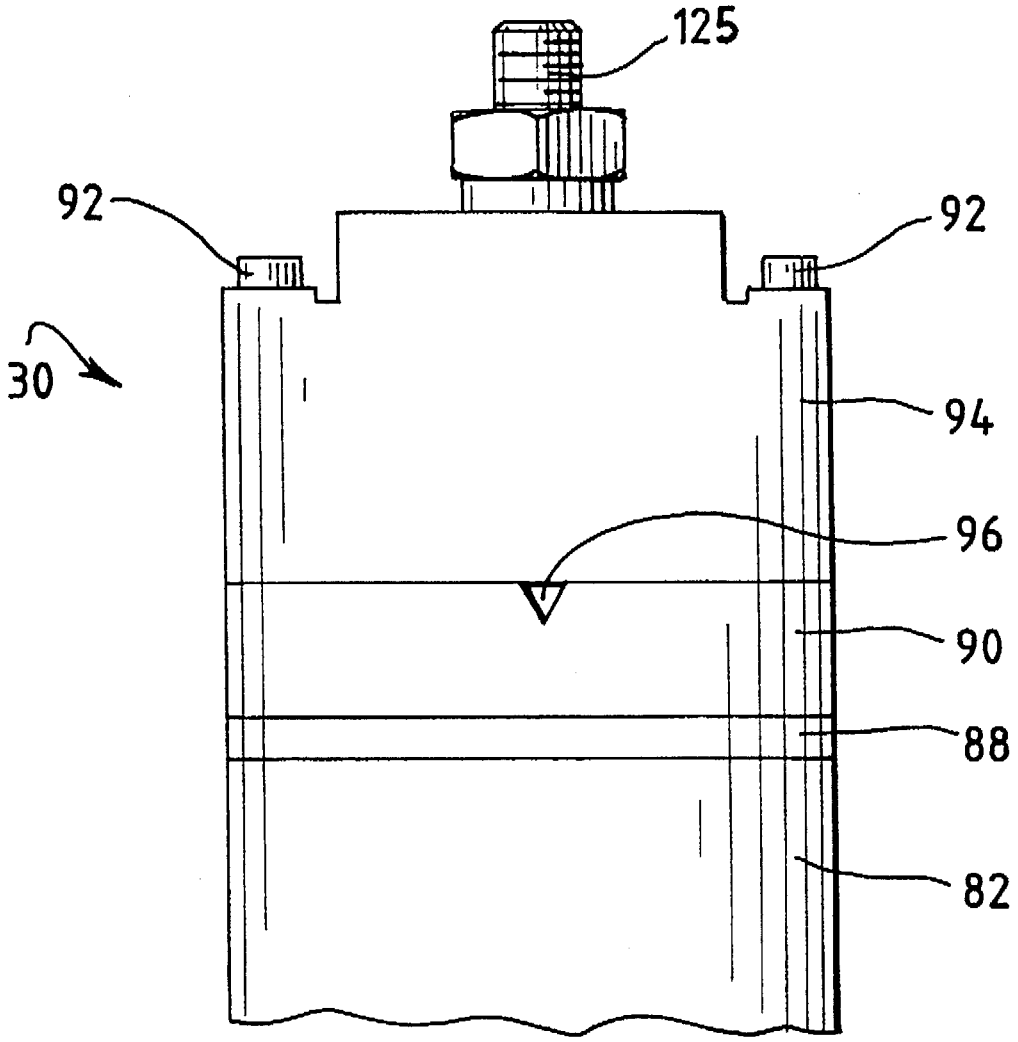
FIG. 4 comprises a partial elevational side view of the spill control valve illustrated in FIG. 3.

The valve body 54 also includes a lower pole piece 82 which is made of magnetically permeable material and which is mounted on the barrel 66. The lower pole piece 82 includes an inner pole piece section 84 and an outer pole piece section 86. An annular upper pole piece 88, which is also made of a magnetically permeable material, and an annular shaped ring 90 are mounted above the outer pole piece section 86 and are held in position by a series of bolts 92 (only one of which is shown in FIG. 3) which extend though an injector cap 94 and into the lower pole piece 82. Preferably, the annular ring 90 is made of magnetically non-permeable material and includes a vent or fluid passageway 96 (shown in FIGS. 2–3) therethrough. As illustrated in FIG. 4, the cross section of the fluid passageway 96 is preferably triangularly-shaped and extends through the annular ring 90 at an upper portion thereof. Alternatively, the cross section of the fluid passageway 96 can be any other desired shape and can extend through any other portion of the annular ring 90 or another structure, as desired.

The poppet valve 52 has a valve seating portion or stem 100 which is slidably mounted within a bore 102 of the barrel 66. When the poppet valve 52 is in a closed position, as shown in FIG. 3, an end portion 104 of the valve stem 100 sealingly engages a seating surface 106 located on the valve seat 60 thereby to block the flow of fuel through the fuel chamber 64 and isolate the inlet fuel conduit 26 from the outlet fuel conduit 32.

The poppet valve 52 also includes a circular shaped armature or head 108, forming a part of the solenoid 38, which is secured by a bolt 118 and two washer-shaped upper and lower shims 120, 121 to the valve stem 100. The armature 108 is made of magnetically permeable material and has a diameter that is larger than the diameter of the valve stem 100. The armature 108 is reciprocally disposed in an armature chamber 110 which is defined by the pole pieces 82 and 88, the annular ring 90, the injector cap 94, and a sealing member 112 fabricated of a nonmagnetically permeable molded material which is located between the upper pole piece 88 and the inner pole piece section 84 of the lower pole piece 82.

A biasing means, such as a return spring 114, is mounted on the inner pole piece section 84 and exerts an upward force against the lower shim 121 and armature 108 to force the armature 108 against a poppet stop 116 which is disposed in the injector cap 94. The spring 114 lifts the valve stem 100 of the poppet valve 52 away from the seating surface 106 of the valve seat 60 to open the spill control valve 30 and allow the inlet fuel conduit 26 to communicate with the outlet fuel conduit 32. The upper and lower shims 120, 121 on either side of the armature 108 are provided to adjust the position of the poppet valve 52 with respect to the flat seating surface 106 and the injector cap 94 when the valve is in the open and closed positions.

The solenoid 38 of the spill control valve 30 further includes a solenoid coil 122 wound on a bobbin 124 which is disposed between the inner and outer pole piece sections 84 and 86, respectively. The solenoid coil 122 is electrically coupled to terminals 125 which, in turn, are coupled to the crank position sensor 34 (shown in FIG. 1). O-rings 126 are provided on either side of an upper flange 127 of the bobbin 124 as illustrated in FIG. 3. The solenoid coil 122 is provided for moving the poppet valve 52 from the spring biased open position, wherein the end portion 104 of the valve stem 100 is spaced from the flat seating surface 106 of the valve seat 60, to the closed position illustrated in FIG. 3.

Importantly, the barrel 66 and the valve stem 100 of the poppet valve 52 are machined so that a slight clearance, preferably, approximately 0.0035 mm plus or minus 0.0013 mm, exists between an outer wall of the valve stem 100 and a wall defining the bore 102 of the barrel 66. This clearance is provided so that fuel within the fuel chamber 64 can flow between the valve stem 100 and the bore wall of the barrel 66, past the return spring 114 and into the armature chamber 110. Fuel that reaches the level of the passageway 96 drains therethrough and may be delivered through an appropriate conduit (not shown) to an engine crankcase.

Due to the narrow clearance between the valve stem 100 and the barrel 66, the flow of fuel into the armature chamber 110 is at a rate which is substantially less than the rate of flow of fuel through the fuel chamber 64 when the poppet valve 52 is in the open position and, preferably, is at a rate at which all of the fuel substantially evaporates upon exiting the armature chamber 110 through the passageway 96.

INDUSTRIAL APPLICABILITY

When the ECM 34 (FIG. 1) energizes the solenoid coil 122 (FIG. 3), magnetic flux travels across the gap between the inner pole piece section 84 and the armature 108, through the armature 108 and back across the gap to the upper pole piece 88. This flux moves the armature 108 towards the pole pieces 82 and 88 until the end portion 104 of the valve stem 100 contacts the seating surface 106 of the valve seat 60. The fuel within the armature chamber 110 acts to dampen the motion of the armature 108 as the valve stem 100 moves towards the closed position and substantially reduces the incidence of bounce of the valve stem 100 when the end portion 104 of the valve stem 100 contacts the valve seat 60. This damping action assures complete closure of the fuel chamber 64 just prior to the actuation of the plunger 42 which pressurizes the fuel within the pumping assembly 24, the inlet fuel conduit 26 and the fuel chamber 64.

The spill poppet valve 52 is held in the closed position until the solenoid coil 122 is deengergized, which ends injection of pressurized fuel into the engine combustion chamber 23. Upon deenergization of the solenoid coil 122, the return spring 114 forces the armature 108 away from the pole pieces 82 and 88 until the stop bolt 118 contacts the poppet stop 116. As a consequence, the valve stem 100 is spaced away from the valve seat 60 to enable fuel to flow from the inlet fuel conduit 26 to the outlet fuel conduit 32. To a lesser extent, the fuel within the armature chamber 110 dampens the upward motion of the armature 108 and the valve stem 100 to prevent bounce of the armature 108 and the valve stem 100 when the return spring 114 forces the stop bolt 118 and/or the armature 108 against the poppet stop 116 and/or the cap 94. This damping action prevents the end portion 104 of the valve stem 100 from reseating against the valve seat 60 and causing a secondary injection of fuel into the engine combustion chamber 23.

Although the control valve 30 has been described as including a single solenoid coil 122 and a return spring 114 for actuating the poppet valve 52, any other mechanisms car be used to actuate the poppet valve 52 including a pair of solenoids located on opposite sides of the armature chamber 110, with or without the return spring 114, wherein energization of one solenoid moves the armature 108 to the open position while energization of the other solenoid moves the armature 108 to the closed position. Alternatively, any other kind of mechanical, electrical, hydraulic, or piezoelectric actuator or a combination thereof may be used instead of the solenoid coil 122. Furthermore, the return spring 114 may be replaced by a permanent magnet or any other mechanism which biases the poppet valve 52 in either the open or the closed position.

Although the control valve 30 has been described as having a passageway formed between the valve stem 100 and the walls defining the bore 102, any other desired passageway can be used to deliver damping fuel from the fuel chamber 64 or any other source of fuel to the armature chamber 110, including a passageway extending through one or more of the valve members, such as the valve stem 100, the barrel 66 or any other part of the control valve 30.

Furthermore, any other desired damping fluid, including, for example, engine oil, can be delivered to the armature chamber 110 to prevent bounce of the poppet valve 52. The optimum amount of damping fluid delivered to the armature chamber 110 and the optimum height to which it is allowed to accumulate, is dependent upon the type of fluid used and desired performance characteristics of the spill control valve.

Still further, although the invention has been described in conjunction with the poppet valve 52 used in the spill control valve 30 of the fuel injector 18, the invention can also be used in conjunction with any other type of moveable valve, for example, a check valve or spool valve. The invention can also be used with any type of fuel injectors including, for example, hydraulically actuated, electronically controlled unit injectors and fuel injectors used in pump-line-nozzle fuel injection systems.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A valve for a fuel injector, comprising:

a moveable valve member disposed in a first chamber and movable to an open position to allow a first fluid to pass;

means coupled to the valve member and disposed in a second chamber for damping motion of the valve member when a second fluid is present in the second chamber;

means extending into the second chamber for admitting the second fluid therein; and means for draining the second fluid from the second chamber, wherein the admitting means connects the first chamber to the second chamber, the first fluid comprises fuel which flows through the first chamber, the admitting means has a fluid flow capacity which is substantially less than the flow capacity of the first chamber and the flow capacity of the admitting means is such that the second fluid within the second chamber substantially evaporates upon exiting the second chamber through the draining means.

2. The valve of claim 1, wherein the moveable valve member reciprocates between a closed position, wherein the valve member blocks the flow of fluid through the first chamber, and the open position.

3. The valve of claim 1, wherein the damping means includes a valve head which reciprocates within the second chamber and displaces the second fluid within the second chamber during reciprocal motion.

4. The valve of claim 3, wherein the valve member and the valve head are circular in cross-section and wherein the valve head has a greater diameter than the valve member.

5. The valve of claim 1, wherein the valve member is disposed within a bore of a valve element such that a narrow passageway exists between an outer surface of the valve member and an inner surface of the bore and wherein the admitting means comprises the narrow passageway.

6. The valve of claim 1, wherein the draining means comprises a passageway disposed at a predetermined level in the second chamber which allows the second fluid to accumulate to the predetermined level.

7. The valve of claim 6, wherein the passageway is triangularly-shaped.

8. An injector, comprising:

a fluid inlet;

a fluid outlet;

a first chamber connecting the fluid inlet to the fluid outlet;

a valve member reciprocable between a first position wherein the valve member blocks the first chamber to isolate the fluid inlet from the fluid outlet, and a second position;

means coupled to the valve member and disposed in a second chamber for damping the motion of the valve member;

a first fluid passageway connecting the first chamber to the second chamber; and a second fluid passageway extending from the second chamber which drains fluid from the second chamber, wherein the valve member is reciprocally disposed in a barrel such that a slight clearance exists between the valve member and the barrel, the first passageway comprises the slight clearance between the valve member and the barrel and the slight clearance is approximately 0.0035 millimeters in width.

9. The injector of claim 8, wherein the second fluid passageway extends into the second chamber at a predetermined level so fluid accumulates to the predetermined level in the second chamber.

10. The injector of claim 9, further including means for moving the valve member between the first and second positions.

11. The injector of claim 10, wherein the damping means includes an armature and the moving means includes a coil disposed adjacent to the armature to actuate the armature when the coil is energized.

12. The injector of claim 11, wherein the armature rests against a stop when the coil is deenergized and wherein energization of the coil moves the valve member to the first position.

13. The injector of claim 12, wherein the moving means further includes a spring which biases the valve member to the second position.

14. The injector of claim 8, wherein the fluid is fuel.

15. The injector of claim 8, wherein the fluid in the first chamber is capable of being pressurized and wherein the fluid in the second chamber remains at a substantially constant pressure.

16. The injector of claim 8, wherein the second fluid passageway is triangularly-shaped.

17. An injector, comprising:

a fluid inlet;

a fluid outlet;

a first chamber connecting the fluid inlet to the fluid outlet;

a valve member reciprocable between a first position wherein the valve member blocks the first chamber to isolate the fluid inlet from the fluid outlet, and a second position;

means coupled to the valve member and disposed in a second chamber for damping the motion of the valve member;

a first fluid passageway connecting the first chamber to the second chamber; and a second fluid passageway extending from the second chamber which drains fluid from the second chamber, wherein the first chamber has a first fluid flow capacity, the first passageway has a second fluid flow capacity which is substantially less than the first fluid flow capacity and the flow capacity of the first passageway is such that fluid substantially evaporates upon exiting the second chamber through the second fluid passageway.

* * * * *